US008021603B2

(12) United States Patent
Thillen et al.

(10) Patent No.: US 8,021,603 B2
(45) Date of Patent: Sep. 20, 2011

(54) ROTARY CHARGING DEVICE FOR A SHAFT FURNACE EQUIPPED WITH A COOLING SYSTEM

(75) Inventors: Guy Thillen, Diekirch (LU); Jeannot Loutsch, Mondercange (LU); Patrick Hutmacher, Bettembourg (LU); Emile Lonardi, Bascharage (LU); Paul Tockert, Luxembourg (LU)

(73) Assignee: Paul Wurth S.A., Luxembourg (LU)

( * ) Notice: Subject to any disclaimer, the term of this patent is extended or adjusted under 35 U.S.C. 154(b) by 598 days.

(21) Appl. No.: 12/158,955

(22) PCT Filed: Oct. 3, 2006

(86) PCT No.: PCT/EP2006/066995

§ 371 (c)(1),
(2), (4) Date: Jun. 23, 2008

(87) PCT Pub. No.: WO2007/071469

PCT Pub. Date: Jun. 28, 2007

(65) Prior Publication Data

US 2008/0290567 A1 Nov. 27, 2008

(30) Foreign Application Priority Data

Dec. 23, 2005 (EP) ..... 05112927

(51) Int. Cl.
*C21B 7/18* (2006.01)

(52) U.S. Cl. ..... 266/241; 266/46

(58) Field of Classification Search ..... 266/46, 266/199, 241

See application file for complete search history.

(56) References Cited

U.S. PATENT DOCUMENTS

| | | | | |
|---|---|---|---|---|
| 4,526,536 | A * | 7/1985 | Legille et al. | 432/238 |
| 5,252,063 | A | 10/1993 | Thillen et al. | |
| 6,544,468 | B1 * | 4/2003 | Londardi et al. | 266/46 |
| 2004/0224275 | A1 | 11/2004 | Lonardi et al. | |

FOREIGN PATENT DOCUMENTS

| | | | |
|---|---|---|---|
| EP | 0116142 | | 8/1984 |
| FR | 2537708 | A1 * | 6/1984 |
| JP | 55021577 | | 2/1980 |
| LU | 84520 | | 10/1984 |
| WO | 9928510 | | 6/1999 |

OTHER PUBLICATIONS

A International Search Report PCT/EP2006/066995 Dated Mar. 29, 2007.

* cited by examiner

*Primary Examiner* — Scott Kastler
(74) *Attorney, Agent, or Firm* — Cantor Colburn LLP

(57) ABSTRACT

A rotary charging device for a shaft furnace, in particular a blast furnace, is disclosed. The charging device is equipped with a cooling system. The rotary charging device includes a rotatable support for rotary distribution means as well as a stationary housing for the rotatable support. The cooling system includes a rotary cooling circuit fixed in rotation with the rotatable support as well as a stationary cooling circuit on the stationary housing. A heat transfer device is provided which includes a stationary heat transfer element configured to be cooled by a cooling fluid flowing through the stationary cooling circuit and which includes a rotary heat transfer element configured to be heated by a separate cooling fluid circulated in the rotary cooling circuit. These heat transfer elements are arranged in facing relationship and have there between a heat transfer region for achieving heat transfer by convection and/or radiation through the heat transfer region without mixing of the separate cooling fluids of the rotary and stationary cooling circuits.

24 Claims, 9 Drawing Sheets

ROTARY CHARGING DEVICE FOR A SHAFT FURNACE EQUIPPED WITH A COOLING SYSTEM

TECHNICAL FIELD OF THE INVENTION

The present invention generally relates to a cooling system equipping a rotary charging device arranged on a shaft furnace such as a metallurgical blast furnace.

BRIEF DISCUSSION OF RELATED ART

Today, many metallurgical shaft furnaces, in particular blast furnaces, are equipped with a rotary charging device for feeding charge material into the furnace. Such a rotary charging device is typically arranged on the furnace throat and therefore at least partially exposed to the high temperatures existing inside the furnace during operation. Consequently, efficient cooling of the exposed parts of the charging device and especially its drive and gear components is important in order to avoid damage, reduce maintenance interventions and increase service life of the charging device. A particular difficulty exists in efficiently carrying away heat from the rotating parts of the charging device which are generally most exposed to furnace heat.

A known approach for cooling a charging device consists in injecting an inert cooling gas into the housing of the charging device at a pressure exceeding the operating pressure at the throat. While presenting the advantage of reducing dust accumulation inside the charging device, this approach has a very limited cooling efficiency. This approach has been described e.g. in JP 55 021577 A.

EP 0 116 142 discloses a water cooling apparatus for a charging device of a shaft furnace, particularly for a charging device having a rotary chute with variable inclination. This cooling apparatus comprises an annular feed vat which is attached to the upper portion of a rotary shell and movable with the shell. The vat is provided with at least one opening whereby water is gravity fed from the vat through plural cooling coils positioned about a rotary jacket. A collecting vat receives the water flowing from the coils. The rotary jacket supports the rotary chute and also acts as the separating structure between the furnace interior and the component parts of the charging device. This water cooling apparatus provides significantly improved cooling efficiency over inert gas cooling. A drawback of this cooling apparatus is however due to the fact that the required cooling water circuit is partially open to the environment, i.e. at the feed vat and the collecting vat. Consequently, the cooling water happens to be contaminated, e.g. with fine particles and furnace dust. Therefore, a special installation is required for treatment of used cooling water. Using inert gas injection this problem can be reduced but not completely eliminated.

WO99/28510 describes a device which has a ring-shaped rotary joint with a fixed ring-shaped part and a rotary ring-shaped part for supplying cooling liquid to rotary cooling coils. The improvement according to WO99/28510 essentially consists in feeding the fixed part of the rotary joint with cooling liquid in excess, such that a leakage flow is produced. This leakage flow passes in a separating slot between the fixed and the rotating part of the rotary joint in order to form a liquid joint in this slot. As a result, contamination of the cooling liquid is significantly reduced or eliminated. This solution requires however a relatively elaborate and therefore expensive ring-shaped joint construction. Unfortunately, the joint elements are subject to considerable wear and therefore require frequent and labour-consuming replacement.

BRIEF SUMMARY OF THE INVENTION

Accordingly, the invention provides an efficient cooling system equipping a rotary charging device for a shaft furnace, which eliminates the need for a complex, expensive and maintenance prone joint between the stationary and the rotary part of the charging device.

The invention proposes a rotary charging device for a shaft furnace, which is equipped with a cooling system, wherein the rotary charging device comprises a rotatable support for rotary distribution means as well as a stationary housing for the rotatable support, and wherein the cooling system comprises a rotary cooling circuit fixed in rotation with the rotatable support as well as a stationary cooling circuit on the stationary housing. According to an important aspect of the invention, a heat transfer device is provided which includes a stationary heat transfer element configured to be cooled by a cooling fluid flowing through the stationary cooling circuit and which includes a rotary heat transfer element configured to be heated by a separate cooling fluid circulated in the rotary cooling circuit. These heat transfer elements are arranged in facing relationship and have there between a heat transfer region for achieving heat transfer by convection and/or radiation through the heat transfer region without mixing of the separate cooling fluids of the rotary and stationary cooling circuits.

In the heat transfer device, the rotary and the stationary heat transfer elements are separated by a small gap or interval which forms the region through which heat transfer occurs. The heat transfer device enables heat transfer between the rotary and the stationary cooling circuits while also providing fluidic separation between the latter circuits. Hence, the need for a rotary joint between the circuits is completely eliminated. In fact, the long established principle of a fluidic connection between the cooling circuits is rendered obsolete by virtue of the heat transfer device according to the invention. Furthermore the need for relatively frequent maintenance interventions, related to replacing the wearing parts of the rotary joint or to cleaning the rotary cooling coils, is also eliminated.

Preferably, the rotary cooling circuit is configured as closed circuit. As a result of a closed recirculation arrangement, the cooling liquid used in the rotary cooling circuit can be pressurized so as to increase its vaporization point. In fact, in the prior art cooling systems, significant pressurizing is not practicable because either the circuit is not fully closed (cf. EP 0 116 142) or because an unacceptable loss of cooling liquid would occur through the rotary joint (cf. WO99/28510). There being no liquid loss and no contamination, it is now feasible to use a more expensive cooling fluid in the rotary cooling circuit. By eliminating the risk of deposits caused by evaporation, both the over-pressure and an adequate fluid enable a higher operating temperature of the rotary cooling circuit. In addition, since there is no need to maintain a purely gravitational flow of the cooling liquid in order to warrant sufficient cooling, a higher pressure drop can be accepted in the rotary cooling circuit. As a result constructional constraints and costs are reduced.

In a first configuration, the rotary cooling circuit can be configured as closed loop natural convection circuit. In a second configuration the rotary cooling circuit can comprise at least one heat pipe. These configurations are of relatively simple construction requiring no actuated parts and no power supply while insuring a reasonable cooling efficiency. Furthermore, these configurations are maintenance friendly, requiring little if any service interventions.

In a third configuration, the rotary cooling circuit can be configured as closed loop forced convection circuit. In a fourth configuration, the rotary cooling circuit is configured as closed loop vapour-compression refrigeration cycle and in a fifth configuration the rotary cooling circuit is configured as an adsorption cooling unit. These configurations require some actuated and powered parts such as a pump or compressor and possibly control valves. Although each of the latter constructions is more expensive compared to the first two configurations, they provide a further increase in cooling efficiency while still requiring little maintenance. As will be appreciated, a closed cycle configuration with forced circulation allows a considerable increase in cooling fluid velocity when compared to gravitational flow cooling (known from EP 0 116 142 and WO99/28510) with the resulting improvement in cooling efficiency. Although generally not required, the cooling system could also comprise a combination of two or more of these configurations.

Powering the pump or compressor can be achieved mechanically by means of a mechanism actuated by rotation of the rotatable support. Alternatively or complementary, powering can be achieved electrically either by means of a battery fed by a generator actuated by rotation of the rotatable support, by means of sliding contacts or by means of non-contacting inductive current transfer.

It will be appreciated that, by virtue of the heat transfer device providing fluidic separation between the rotary and the stationary cooling circuit, contamination of either cooling liquid in the stationary and rotary cooling circuits is eliminated. Therefore, there is no need for a treatment installation. Furthermore, the stationary cooling circuit can be arranged as integral part of a closed loop cooling circuit of the shaft furnace for carrying away heat transferred to the stationary heat transfer element. Shaft furnaces, in particular blast furnaces, are in most cases equipped with a closed cycle cooling system, e.g. for cooling the furnace shell. Hence the total cost of the cooling system equipping the charging device is considerably reduced, both by eliminating the treatment installation and by taking advantage of existing infrastructure.

In order to provide a substantial heat transfer surface in the heat transfer device, it is advantageous to have at least one recess provided in the rotary or the stationary heat transfer element and at least one corresponding protrusion provided in the stationary or the rotary heat transfer element. This recess and this protrusion fit together so as to give a meandering vertical cross-section to the heat transfer region and hence increase the total juxtaposed facing surfaces of the heat transfer elements. As will be appreciated, a plurality of interpenetrating or interdigitating recesses and protrusions can be provided to further increase the effective heat transfer surface.

In another simple construction providing a substantial heat transfer surface, the rotary heat transfer element and the stationary heat transfer element each comprise an annular base part and at least one protrusion protruding transversely from the base part, the protrusions being arranged in facing relationship and fitting together so as to give a meandering vertical cross-section to the heat transfer region.

Preferably, the heat transfer region is at least partially filled with a thermally conductive liquid in order to increase heat transfer efficiency. In a further beneficial arrangement, at least one protrusion of said rotary heat transfer element and/or said stationary heat transfer element comprises means for turbulating said thermally conductive liquid. Turbulence in the liquid allows to further increase achievable heat transfer. Preferably, the transverse width of the heat transfer region is in the range of 0.5-3 mm.

Furthermore, the rotary cooling circuit can comprise a circuit portion for cooling a rotary distribution chute supported by the rotatable support, which is one of the most exposed components of a charging device of the so called BELL LESS TOP type.

Since the cooling system is readily suitable for use in a blast furnace, the invention also relates to a blast furnace comprising a charging device equipped with a cooling system as described above.

BRIEF DESCRIPTION OF THE FIGURES

The present invention will be more apparent from the following description of various not limiting embodiments with reference to the attached drawings in which identical reference numerals or reference numerals with incremented hundreds digit are used to indicate identical or similar elements throughout. In these drawings.

DETAILED DESCRIPTION OF THE INVENTION

Figure 1:
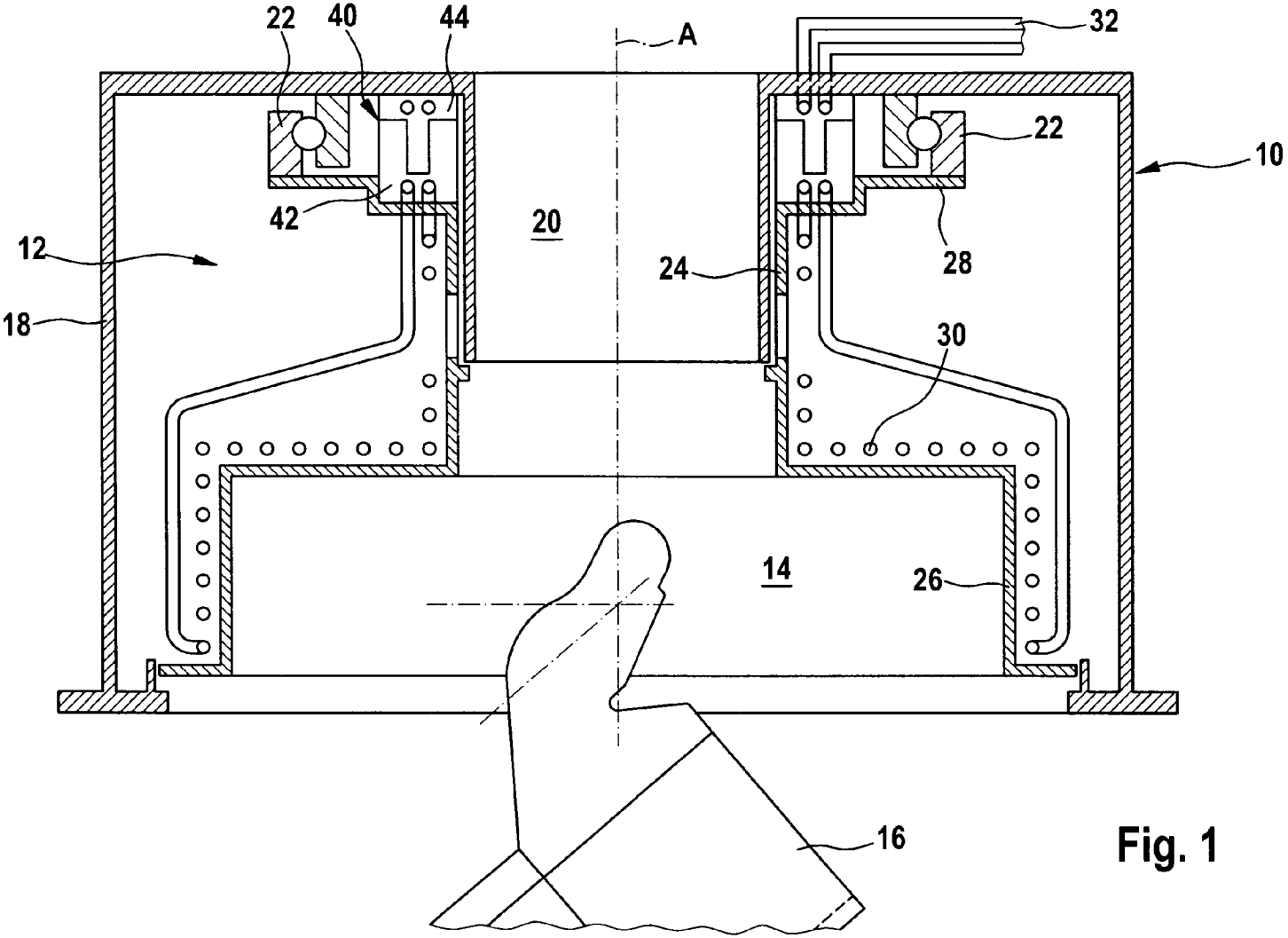
FIG. 1: is a partial vertical cross-sectional view of a charging device for a shaft furnace equipped with a cooling system according to the invention.

FIG. 1 partially shows a rotary charging device, generally identified by reference numeral 10, for a blast furnace. The rotary charging device 10 is equipped with a cooling system 12 for cooling the components heated by the process temperature inside the furnace. In the charging device 10, a rotatable support 14 serves to support a rotary chute 16. The rotary chute 16 is attached to the rotatable support 14 by means of a suspension for varying the angle of inclination of the rotary chute 16. The rotary charging device 10 further comprises a stationary housing 18 within which the rotatable support 14 is arranged. The stationary housing 18 comprises a fixed central feed channel 20 which is arranged on the central axis A of the furnace. During the charging procedure, in a manner known per se, bulk material is fed via the feed channel 20, through the stationary housing 18 and the rotatable support 14, onto the rotary chute 16 by which it is distributed inside the furnace according to the inclination and rotation of the chute 16.

Except for the cooling system 12, the configuration of the charging device 10 itself is known and commonly called BELL LESS TOP™ (BLT). Various known stationary and rotatable components of the charging device 10, such as drive and gear components, are not shown in FIG. 1. These are described in detail e.g. in U.S. Pat. No. 3,880,302.

As seen in FIG. 1, the support 14 is mounted rotatable about axis A, inside the stationary housing 18 by means of a bearing 22. The rotatable support 14 has an essentially annular configuration with a central passage for bulk material in prolongation of the central feed channel 20. It comprises a cylindrical inner wall portion 24 adjacent the central feed channel 20, a lower flange portion 26 for supporting the chute 16 and an upper flange portion 28 to which the bearing 22 is mounted. The stationary housing 18 and the rotatable support 14 constitute the casing of the rotary charging device 10. Furthermore, they form the top closure on the throat of a blast furnace not entirely shown in FIG. 1.

As further shown in FIG. 1, the cooling system 12 comprises a rotary cooling circuit 30 fixed on the rotatable support 14 and a stationary cooling circuit 32 (only partially shown) on the stationary housing 18. During operation, the rotary cooling circuit 30 rotates with the support 14 whereas the stationary cooling circuit 32 remains stationary with the housing 18. The rotary cooling circuit 30 is arranged in thermal contact with the inner wall portion 24 and the lower flange portion 26, on the side opposite to the passage for bulk material in order to insure cooling of those parts of the charging device 10, which are exposed to the furnace heat. In addition, it also provides cooling of the drive and gear components (not shown) of the charging device 10.

During operation, the cooling system 12 carries away heat collected by the rotary cooling circuit 30 via the stationary cooling circuit 32. To this purpose, as best seen in FIG. 1, the cooling system 12 comprises a heat transfer device 40 which thermally connects the rotary cooling circuit 30 with the stationary cooling circuit 32. The heat transfer device 40 comprises a rotary heat transfer element 42, which is attached to the rotatable support 14 at the upper flange portion 28, and a stationary heat transfer element 44, which is attached underneath the top cover of the stationary housing 18. The rotary element 42 is connected to and part of the rotary cooling circuit 30 and the stationary element 44 is connected to and part of the stationary cooling circuit 32. During operation, the stationary heat transfer element 44 is cooled by a cooling fluid flowing through the stationary cooling circuit 32 whereas the rotary heat transfer element 42 is heated by a separate cooling fluid circulated in the rotary cooling circuit 30, as will be detailed below. In order to allow unimpeded rotation of the rotary element 42 with respect to the stationary element 44, the elements 42, 44 are separated by a relatively small open space defining a heat transfer region. As will be appreciated, the elements 42, 44 are arranged in facing relationship, i.e. juxtaposed but not contacting. Due to the temperature drop between the elements 42, 44 during operation, efficient heat transfer from the rotary cooling circuit 30 to the stationary cooling circuit 32 is achieved through the heat transfer region by convection and/or radiation in the medium between the elements 42, 44. It will be appreciated that there is no mixing of the respective cooling fluids of the rotary 30 and stationary cooling circuit 32, i.e. heat transfer occurs without exchange of cooling fluid between the latter. From FIG. 1 it is apparent that the rotary and stationary elements 42, 44 have a rotationally symmetrical configuration centred on the axis of rotation A. Although not shown in horizontal cross-section, the elements 42 and 44 are arranged as circular ring, extending essentially over the entire circumference about axis A, in order to maximize heat transfer. The elements 42 and 44 have matching profiles fitting together both in vertical (radially) and in horizontal projection (circumferentially).

The heat transfer elements 42, 44 provide fluidic separation between the rotary and the stationary cooling circuit 30, 32 such that the cooling fluids of the latter do not mix. Furthermore, the heat transfer elements 42, 44 allow to configure each one of the rotary cooling circuit 30 and the stationary cooling circuit 32 in a closed cycle configuration as will be detailed below. Although, the cooling system 12 is described herein in the context of a charging device 10 of the BLT type on a blast furnace, it can also be used in connection with other types of rotary charging devices for shaft furnaces.

By reference to FIGS. 2-5, some variants of suitable heat transfer elements will be detailed below. Along the description, recurring features of a previously described variant may be omitted.

Figure 2:
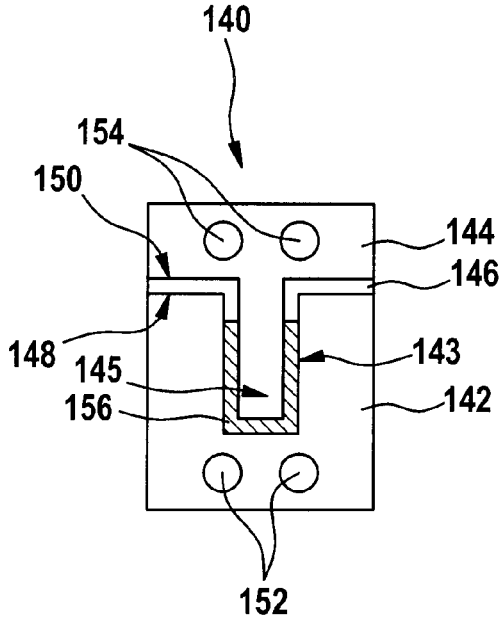
FIG. 2: is a vertical cross-sectional view of a heat transfer device comprising a rotary and a stationary heat transfer element for use in the cooling system of FIG. 1.

FIG. 2 shows in more detail a first variant of a heat transfer device 140 comprising a rotary heat transfer element 142 and a stationary heat transfer element 144. In the variant of FIG. 2, the rotary element 142 comprises a vertical recess 143 into which extends a conjugated vertical protrusion 145 of the stationary element 144. Hence, the rotary element 142 has a generally U-shaped vertical cross-section whereas the stationary element 144 has a generally T-shaped vertical cross-section. Both juxtaposed elements 142 and 144, in particular the protrusion 143 and the recess 145, are dimensioned to match such that a relatively small heat transfer region 146 of approximately uniform transverse width exists between their respective heat transfer surfaces 148 and 150. The transverse width of the heat transfer region 146 is set in accordance with the vertical and horizontal motional tolerance of the rotating components of the charging device 10, and in accordance with the tolerance due to differing thermal dilatation, which together are normally in the order of a few tenths of millimetres in vertical and horizontal direction. Therefore, a region 146 of relatively small uniform transverse width (e.g. 1 mm), warrants unimpeded rotation without compromising heat transfer. Nevertheless differing horizontal and vertical transverse widths are also possible depending on the actual requirements of the charging device 10. As seen in the vertical cross-section of FIG. 2, the complementary conjugated shapes of the facing elements 142 and 144, produce a meandering in the vertical cross-section of the region 146 which provides a relatively large effective area of the heat transfer surfaces 148 and 150. Where required and not impeded by constructional constraints, this area can be further increased, e.g. by enlarging the radius of the annular elements 142 and 144, as detailed below with respect to FIGS. 11-17, and/or by additional meandering as detailed below with respect to FIGS. 4 and 5.

As seen in FIG. 2, each heat transfer element 142, 144 comprises internal channels 152 respectively 154 for a cooling fluid. As is apparent from FIG. 1, each internal channel 152 or 154 is part of the rotary or stationary cooling circuit 30 or 32 respectively. In order to increase efficiency of thermal transfer, the lower trough portion of the region 146 is filled with a thermal coupling fluid 156, which in FIG. 2 represents a heat conductive liquid, such as water or a highly conductive liquid with high vaporization point and lubrication capability. A semi-liquid fluid with high viscosity such as a thermally conductive grease could also be used as coupling fluid. Using water as thermal coupling fluid 156, a heat transfer of approximately 20,000 W/($m^2$) during rotation and 6,000 W/($m^2$) at rest can be achieved through a heat transfer region of 1 mm transverse width. These values assume a relative rotational speed of 0.8 m/s and a temperature drop ΔT of 40° C. between the elements 142, 144. Consequently, the heat transfer device 140 insures efficient heat transfer from the rotary cooling circuit 30 to the stationary cooling circuit 32 without exchange of a cooling fluid there between. Depending on the type of liquid 156, a level detection, a filling line controlled by the level detection and leading to the lower part of the region 146, and a supply tank from which issues the filling line (not shown) are provided for automatically compensating possible evaporation of the liquid 156.

Figure 3:
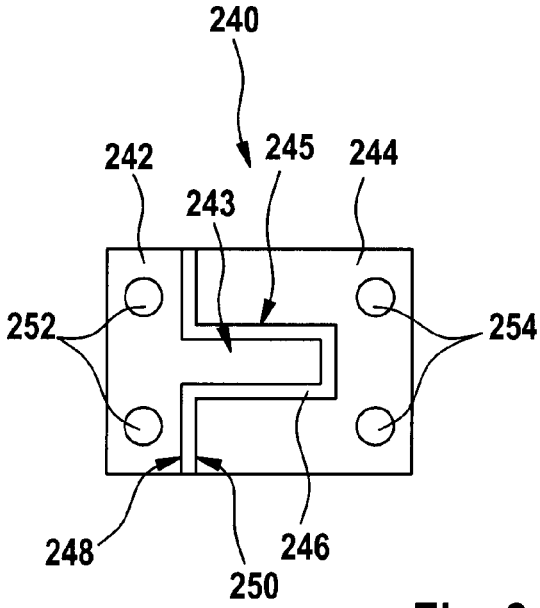
FIG. 3: is a vertical cross-sectional view of an alternative heat transfer device.

FIG. 3 shows a second variant of a heat transfer device 240 comprising a rotary and a stationary heat transfer element 242 and 244. In FIG. 3, a horizontal recess 245 is provided in the stationary element 244. The rotary heat transfer element 242 comprises a horizontal protrusion 243 which is conjugated to the recess 245 and extends into the latter. The juxtaposed elements 242 and 244, in particular the protrusion 243 and the recess 245, form a meandering heat transfer region 246 of uniform transverse width. Without further measures, the variant according to FIG. 3 does not allow filling the heat transfer region 246 with a liquid coupling fluid but even air as a thermal coupling fluid may warrant sufficient heat transfer from first to second internal channels 252 and 254 depending on the total effective area of their respective heat transfer surfaces 248 and 250. In fact, during relative rotation of the elements 242 and 244, a heat transfer of approximately 2,000 W/($m^2$) can be achieved through an air filled heat transfer region of 1 mm transverse width under the above assumptions (rotational speed: 0.8 mls and ΔT of 40° C.). In comparison, a heat transfer of only 600 W/($m^2$) approximately can be achieved at rest. The critical phase however is generally during operation when there is a relative rotation most of the time. The heat transfer device 240 according to FIG. 3 may be preferable because of constructional constraints e.g. where dismantling of the charging device 10 is impossible with a configuration according to FIG. 2.

Figure 4:
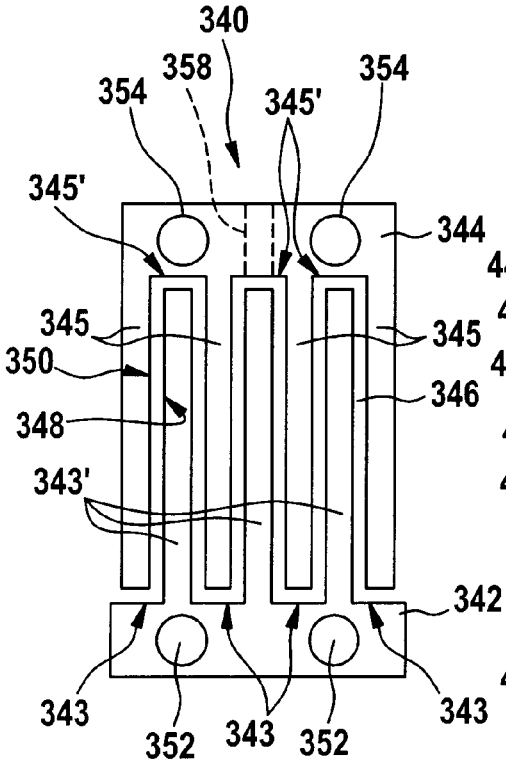
FIG. 4: is a vertical cross-sectional view of another alternative heat transfer device.

FIG. 4 shows a third variant of a heat transfer device 340 with a rotary and a stationary heat transfer element 342 and 344. As seen in FIG. 4, the rotary element 342 comprises both a plurality of vertical recesses 343 and protrusions 343'. The stationary element 344 also comprises both a plurality of vertical protrusions 345 and recesses 345'. In practice, this configuration can be obtained for example, by machining annular grooves of rectangular cross-section at suitable intervals into a massive ring of heat conductive metal for each element. The protrusions 345; 343' and recesses 343; 345' have conjugated shape and are arranged so as to interdigitate. Extensive meandering of the intermediate heat transfer region 346 between the juxtaposed elements 342 and 344 is achieved by means of these conjugated protrusions 345; 343' and recesses 343; 345'. Consequently the effective area of the heat transfer surfaces 348 and 350 is increased without considerable increase in the size of the heat transfer elements 342, 344. The stationary heat transfer element 344 further comprises a plurality of circumferentially distributed channels 358 for flushing gas.

Figure 5:
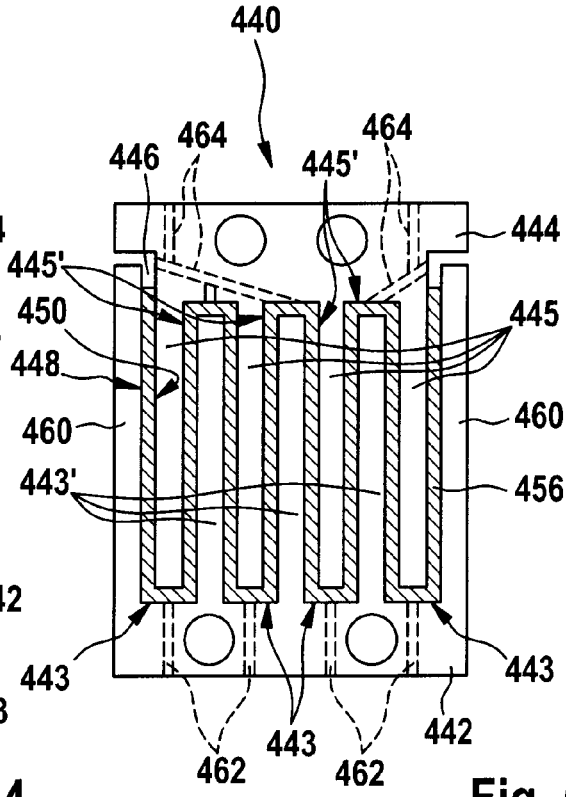
FIG. 5: is a vertical cross-sectional view of a yet another alternative heat transfer device.

FIG. 5 shows a fourth variant of a heat transfer device 440. Analogous to the previous variants, the rotary 442 and stationary heat transfer element 444 are arranged in facing relationship and fit together closely by interpenetration, so as to create a meandering heat transfer region 446 of small transverse width there between. The heat transfer device 440 differs from the preceding variant essentially in three aspects. Firstly, the rotary heat transfer element 442 comprises annular lateral side walls 460 radially delimiting the region 446 and exceeding the interdigitating protrusions 443' and 445 and recesses 443 and 445' in height. Hence, the side walls 460 create a trough containing the interdigitating protrusions and recesses. As a result, the region 446 can be almost completely filled with coupling liquid 456. Secondly, discharging channels 462 are arranged in the rotary heat transfer element 442 for replacing the thermally conductive liquid 456. The discharging channels 462 are circumferentially distributed in the annular rotary element 442, at least one discharge channel 462 being associated to each recess 443. Thirdly, air bleed channels 464 are arranged in the stationary element 444 and connected to each recess 445'. The air bleed channels 464 can also be used for cleaning the region 446 by gas or liquid flushing, once the liquid 456 has been discharged. As will be appreciated, due extensive meandering of the region 446, the effective area of the heat transfer surfaces 448, 450 is significantly larger than with plane opposing surfaces.

By reference to FIGS. 6-10, some configurations of cooling systems according to the invention, in particular of the rotary cooling circuit, will be detailed below. Recurring features already mentioned above may be omitted below.

In the FIGS. 6-9, the heat transfer device is identified by reference numeral 40, although the variants 140, 240, 340 and 440 are equally applicable. Furthermore, the stationary cooling circuit is identified by reference numeral 32 throughout FIGS. 6-10. Due to the heat transfer elements 42, 44, the stationary cooling circuit 32 is devoid of any opening towards the environment in the preferred embodiments. This enables integration of the stationary cooling circuit 32 with the closed circuit soft water cooling system of the blast furnace (not shown). Similarly, the rotary cooling circuit is arranged as closed recirculation cycle. Hence an expensive installation for treatment of the cooling liquid used in the cooling system for the charging device 12 is no longer necessary. The type of cooling fluid used in the rotary cooling circuit will depend on the respective design as will become apparent below.

Figure 6:
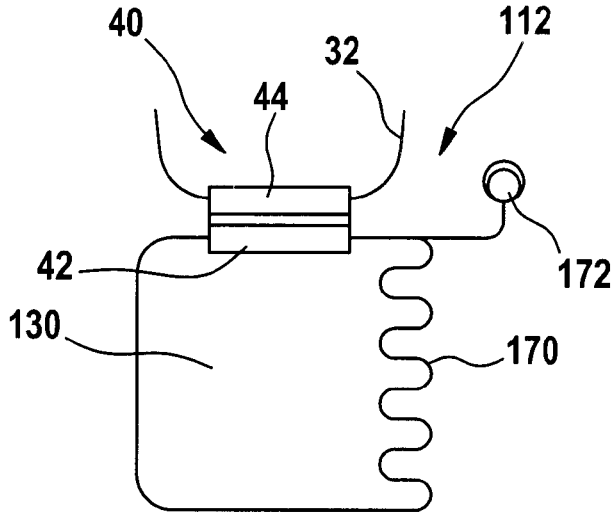
FIG. 6: is a schematic diagram of a first configuration of a rotary cooling circuit for use in the cooling system according to FIG. 1.

A first configuration of a cooling system 112 is shown very schematically in FIG. 6. The rotary cooling circuit 130, is configured as a closed loop natural convection circuit and connected to the heat transfer device 40. The cooling system 112 comprises coiled cooling pipes 170 in thermal contact with the most exposed parts of the charging device 10 (e.g. inner wall portion 24 and lower flange portion 26) and an expansion tank 172, in order to allow pressurizing the cooling fluid so as to increase its vaporization point. Circulation of cooling liquid, e.g. demineralised soft water, occurs in the cooling system 112 by means of natural convection caused by heating of the cooling liquid at the exposed rotary parts and by cooling of the cooling liquid at the rotary heat transfer element 42. It is apparent from FIG. 6 that during operation, the stationary heat transfer element 44 is cooled by a cooling fluid flowing through the stationary cooling circuit 32 whereas the rotary heat transfer element 42 is heated by the separate cooling fluid circulated in the rotary cooling circuit 130. The resulting temperature drop between the elements 42, 44 causes the desired heat transfer in the heat transfer device 40.

Figure 7:
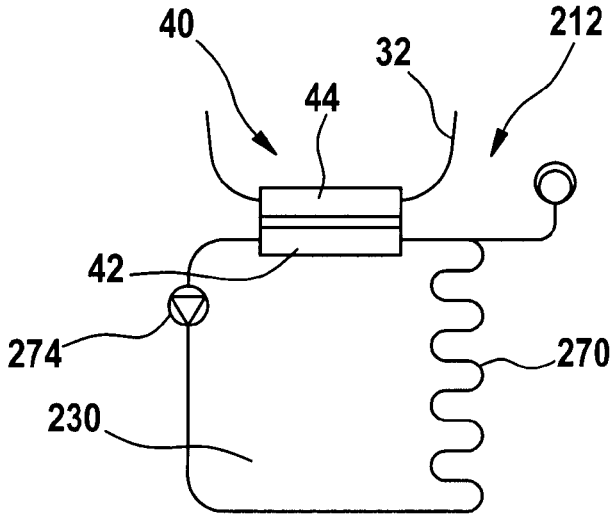
FIG. 7: is a schematic diagram of a second configuration of a rotary cooling circuit.

FIG. 7 shows a second configuration of a cooling system 212 which differs from the previous configuration in that the rotary cooling circuit 230 is configured as closed loop forced convection circuit. Other parts being similar to the first configuration, the cooling system 212 comprises a circulation pump 274 arranged downstream of the heat transfer device 40 so as to insure forced recirculation of the cooling liquid, e.g. demineralised soft water, used in the rotary cooling circuit 230. Electric power supply for the circulation pump 274 can be achieved by various contrivances such as sliding contact collector rings or a generator-battery arrangement (the generator mounted on the support 14 and actuated by rotation of the latter), or non-contacting inductive current transfer (not shown). Alternatively, the circulation pump 274 can be also powered mechanically by means of a mechanism actuated by rotation of the rotatable support 14 as described in LU 84520.

Figure 8:
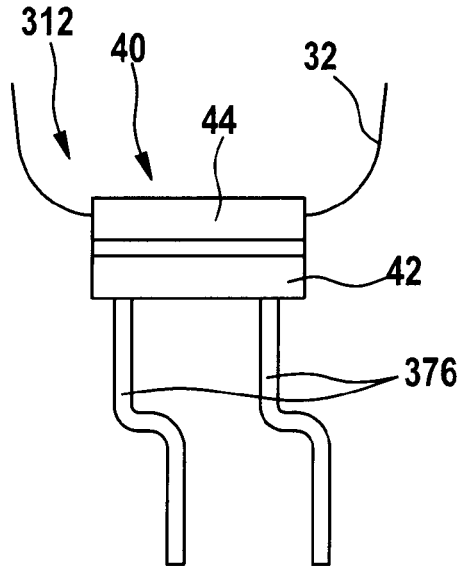
FIG. 8: is a schematic diagram of a third configuration of a rotary cooling circuit.

FIG. 8 shows a third configuration of a cooling system 312. Compared to the other configurations disclosed herein, the rotary cooling circuit 330 according to FIG. 8 comprises a plurality of heat-pipes 376 which are themselves well known. The hot (lower) part of each heat pipe 376 is arranged in thermal contact with the exposed rotary components of the charging device 10, whereas the cold (upper) part of the heat pipes 376 is arranged in thermal contact with the rotary heat transfer element 42. Accordingly, the heat pipes 376 may have a bent shape conforming to the internal construction of the charging device 10. Due to the heat pipes 376, the rotating portion of the cooling system 312 is completely passive, i.e. there is no mechanical parts and no energy required to transport the heat from the parts to be cooled to the rotary heat transfer element 42. Nevertheless, because of the significant amount of energy involved in latent heat, the heat pipes 376 are very effective at heat transfer.

Figure 9:
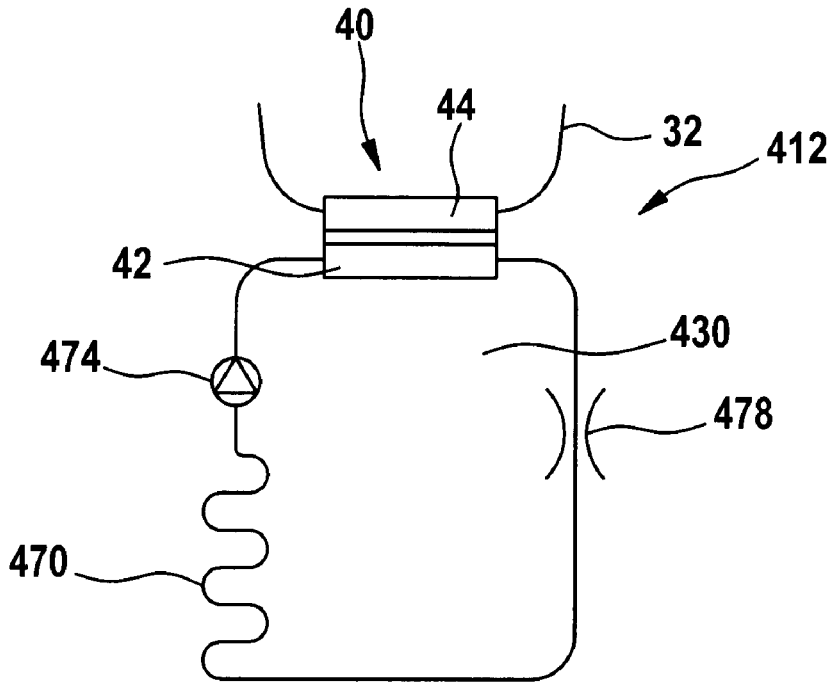
FIG. 9: is a schematic diagram of a fourth configuration of a rotary cooling circuit.

FIG. 9 shows a fourth configuration of a cooling system 412, in which the rotary cooling circuit 430 is configured as a closed loop vapour-compression refrigeration cycle using a suitable refrigerant e.g. of the halogenated hydrocarbon type. Coiled cooling pipes 470, arranged in thermal contact with the parts to be cooled, represent the evaporator of the refrigeration cycle. A compressor 474 upstream of the heat transfer device 40 increases the pressure of the vapour produced in the coiled cooling pipes 470 which is then condensed in the rotary element 42, representing the condenser. The condensed cooling fluid is expanded to evaporator pressure by means of an expansion device 478 downstream of the rotary element 42. Any of the contrivances mentioned in relation to the second configuration can serve as power supply for the compressor 474.

Figure 10:
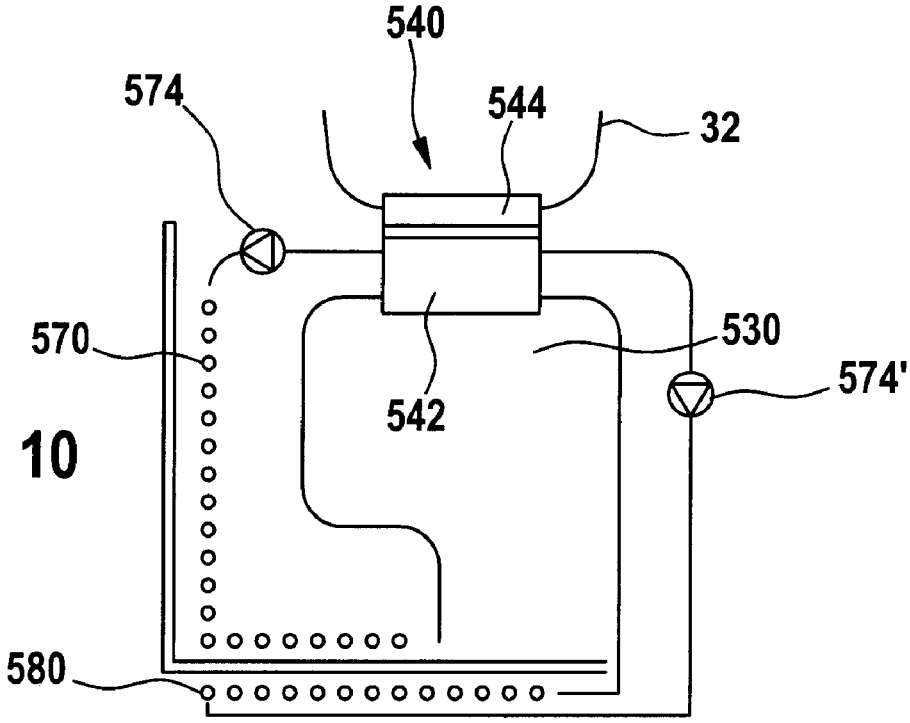
FIG. 10: is a schematic diagram of a fifth configuration of a rotary cooling circuit.

FIG. 10 shows a fifth configuration of a cooling system 512, in which the rotary cooling circuit 530 is configured as an adsorption unit based on the adsorption cycle for cooling. The adsorption unit 530, arranged as bipartite closed cycle, comprises an adsorber with a solid adsorbent, and a condenser for a liquid/gaseous adsorbate, both arranged within the rotary element 542 of a modified heat transfer device 540. The evaporator for the adsorbate, is formed by coiled cooling pipes 570 arranged in thermal contact with the parts to be cooled. A heating system formed by additional coiled heating pipes 580 is arranged on the rotatable lower flange portion 26 so as to face the blast furnace interior. Both circuits of pipes 570 and 580 are connected to the heat transfer device 540. In known manner, the adsorption unit 530 provides intermittent cooling by passing through four different periods during one cycle. As schematically indicated in FIG. 10, the coiled cooling pipes 570 are arranged outside the furnace on the lower flange portion 26 and/or the inner wall portion 24 whereas the coiled heating pipes 580 are arranged on the opposite side, i.e. inside the furnace.

Consequently, the heat transfer device 540 in this fifth configuration has the triple function of carrying away the heat taken up by the coiled cooling pipes 570 and acting as both adsorber and condenser of the adsorption unit 530. The intermittent cycle, i.e. the passage through the different periods of the adsorption unit 530 (heating & pressurizing->desorbing & condensing->cooling & depressurizing->cooling & adsorption) is controlled by means of a first and a second pump 574 and 574' and appropriately arranged valves (not shown). The mechanical/electrical energy for the latter components is provided by means of any of the aforementioned contrivances referring to the second configuration. Although not shown in the drawings, those skilled in the art will be aware that a different configuration can be envisaged based on an adsorption cycle with heat regeneration for quasi-continuous operation of the condenser and evaporator and hence quasi-continuous cooling. Such a configuration does however require additional parts among which in particular a second adsorption unit, which is to be operated out of phase compared to the first adsorption unit.

Figure 11:
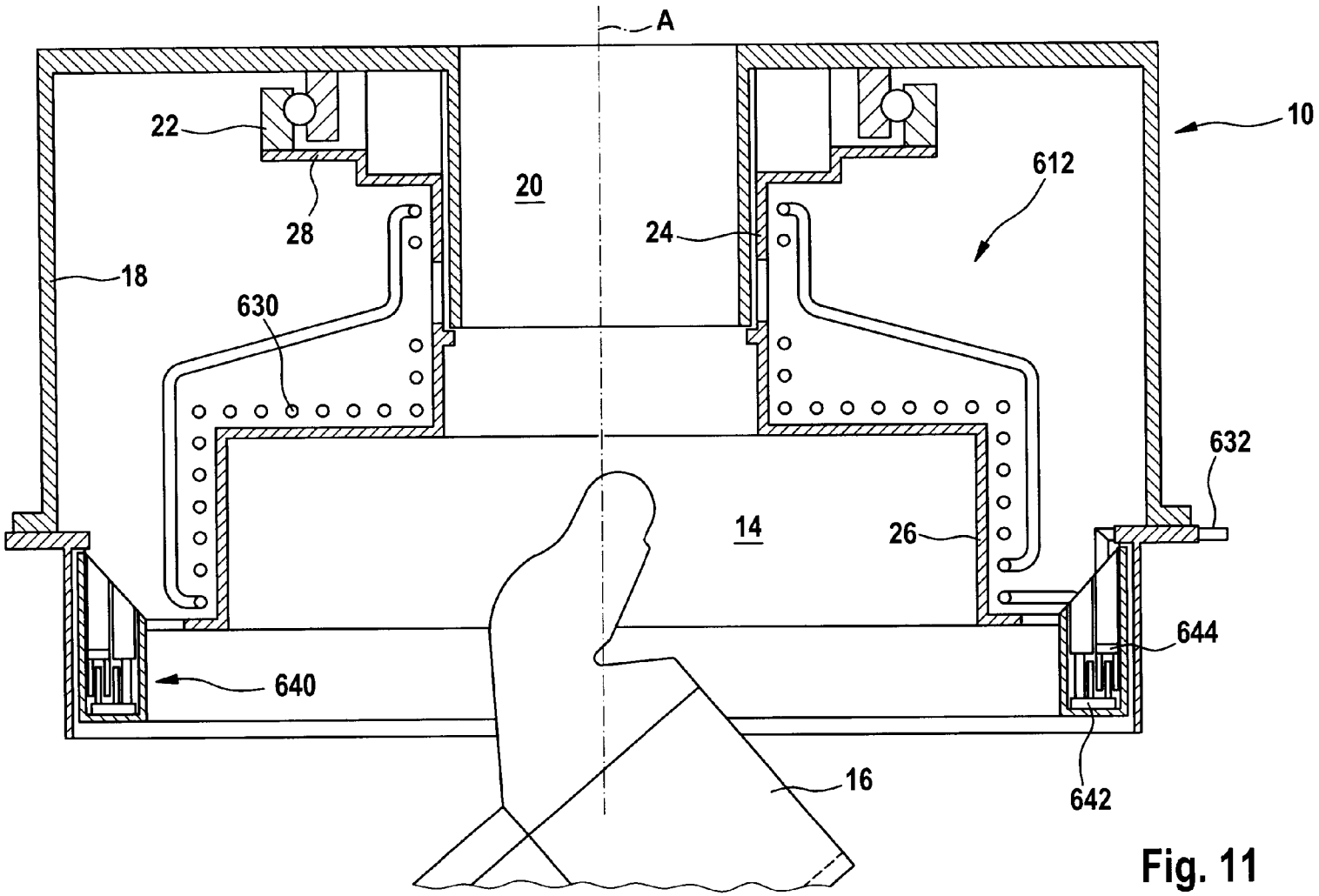
FIG. 11: is a partial vertical cross-sectional view of a charging device for a shaft furnace equipped with an alternative cooling system according to the invention.

FIG. 11 shows an alternative embodiment of a cooling system 612 according to the invention, in a charging device 10 installed on top of a blast furnace. Other parts being similar, only the differences with respect to the embodiment shown in FIG. 1 will be detailed below.

As seen in FIG. 11, the cooling system 612 also comprises a heat transfer device 640 with a rotary heat transfer element 642 and a stationary heat transfer element 644. In the configuration according to FIG. 11, the heat transfer device 640 is arranged in the lower portion of the casing of the rotary charging device 10, more precisely, at the lower periphery of the lower flange portion 26 of the rotatable support 14. Hence, the rotary cooling circuit 630 is connected to the rotary heat transfer element 642 in this lower region. As will be understood, the actual configuration of the rotary cooling circuit 630 may be any of those described above with reference to FIGS. 6-10 or a combination thereof. The stationary cooling circuit 632 is connected to the stationary heat transfer element 644 also in the lower region of the stationary housing 18. As described above, the stationary heat transfer element 644 is cooled by a cooling fluid flowing through the stationary cooling circuit 632, whereas heat is transferred, from the components of the charging device 10 that require cooling, to the rotary heat transfer element 642 by a cooling fluid circulated in the rotary cooling circuit 630. By virtue of the heat transfer device 640, the latter cooling fluid is separate from and does not mix with the cooling fluid in the stationary cooling circuit 632. As will be appreciated, in the embodiment according to FIG. 11, an increased diameter of the generally annular heat transfer device 640 enables a larger total area of facing surfaces of the elements 642, 644, and consequently increased heat transfer when compared to the embodiment of FIG. 1.

Figure 12:
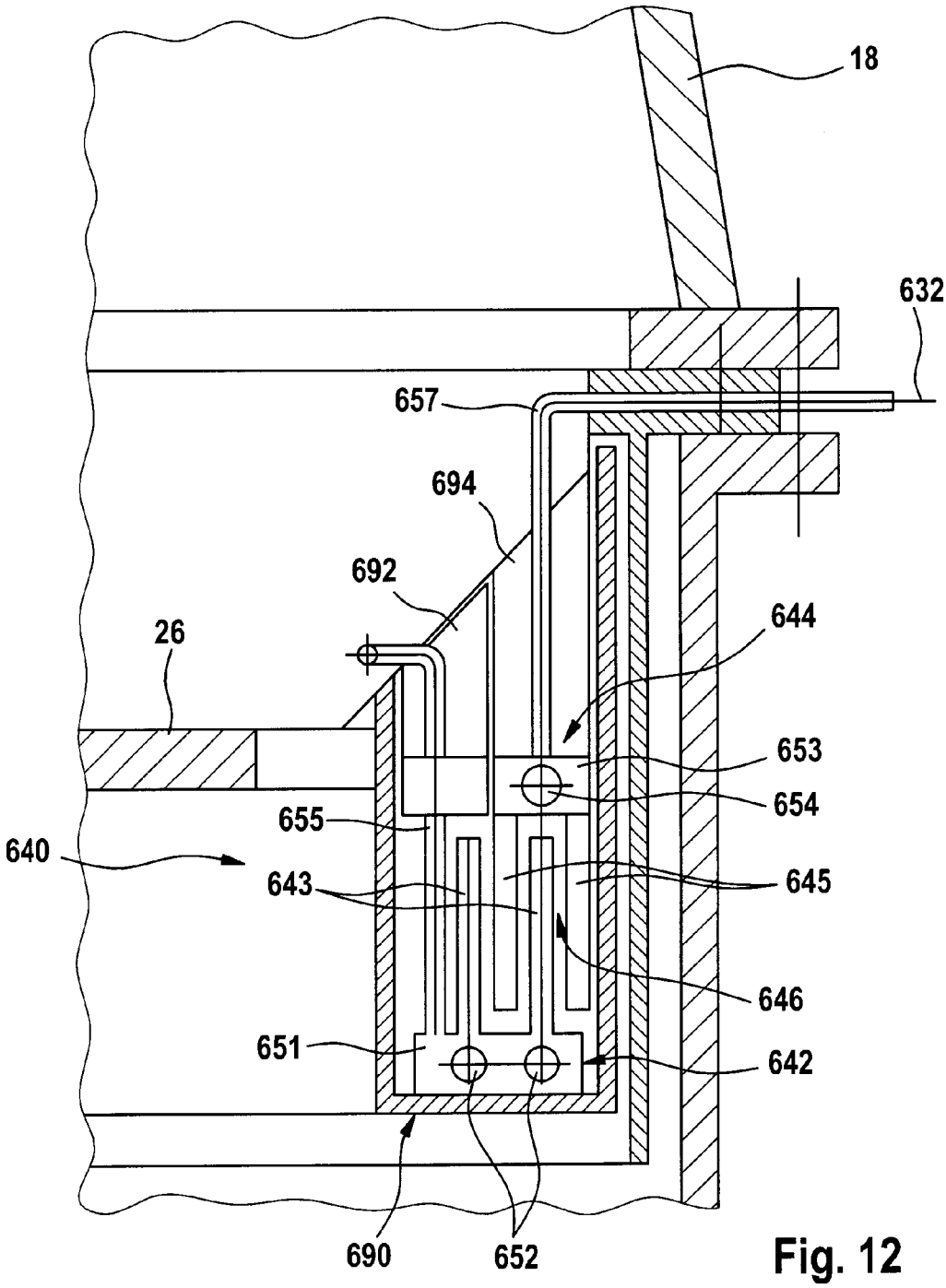
FIG. 12: is an enlarged vertical cross-sectional view of the heat transfer device in the cooling system of FIG. 11.

FIG. 12 shows the heat transfer device 640 of FIG. 11 in more detail. As seen in FIG. 12, both the rotary and stationary heat transfer elements 642 and 644 comprise protrusions 643 respectively 645 configured so as to interdigitate and create there between a small heat transfer region 646 of meandering vertical cross-section. During operation, heat transfer from the rotary element 642 to the stationary element 644, especially from the protrusions 643 to the protrusions 645, is achieved through the heat transfer region 646. As will be understood, this heat transfer occurs by convection and/or radiation in the medium of the heat transfer region 646. Each heat transfer element 642 and 644 comprises a base part 651 respectively 653 in the form of a massive annular ring arranged in rotational symmetry on axis A. The protrusions 643 and 645 project transversely from their base part 651 respectively 653, in case of FIG. 12, vertically towards the other juxtaposed heat transfer element. Internal channels 652 in the base part 651 of the rotary heat transfer element 642 are connected to the rotary cooling circuit 630 by means of connection conduits 655, as seen in FIG. 12. Similarly, connection conduits 657 connect an internal channel 654 in the base part 653 of the stationary heat transfer element 644 to the stationary cooling circuit 632.

In FIG. 12, the heat transfer elements 642, 644 are arranged inside an annular trough 690 serving to contain a thermally conductive liquid as coupling fluid in the heat transfer region 646 between the elements 642, 644 and between their protrusions 643, 645. By installing the heat transfer device 640 inside the through 690, both elements 642, 644 can be immersed in the a heat conductive liquid in order to increase heat transfer there between. As seen in FIG. 12, the trough 690 is fixed in rotation with the rotary heat transfer element 642 and also supports the latter on the lower flange portion 26. As further seen in FIG. 12, each heat transfer element 642, 644 is provided with a respective cover 692 or 694 configured as roof-shaped hood with a slanting upper surface. The covers 692, 694 are arranged adjacent, leaving there between only a small gap permitting relative rotation. The covers 692, 694 allow to reduce the surface of the heat conductive liquid in the heat transfer region 646 which is exposed to airborne dust. Part of the stationary cover 694 is arranged to overlap the rotary cover 692 in order to reduce penetration of dust (e.g. furnace dust) into the liquid in the heat transfer region 646. To the same effect, the outer side wall of the trough 690 extends upwards adjacently along the stationary heat transfer element 644 and its cover 694. Although not shown in FIG. 12, the lower side of the trough 690, which is exposed to the furnace interior, is preferably provided with a suitable thermal insulation in order to reduce the amount of heat transferred to the heat transfer device 640 through the walls of the trough 690.

Figure 13:
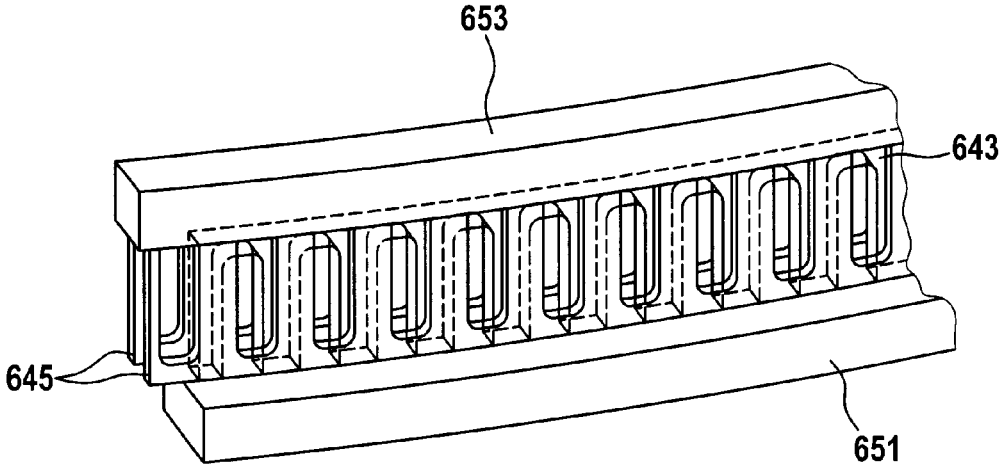
FIG. 13: is a partial isometric view of the heat transfer device in FIG. 12.

FIG. 13 partially shows the annular construction of the heat transfer elements 642, 644. More precisely, the base parts 651 and 653 and their respective protrusions 643 and 645 are shown in part in FIG. 13. Each protrusion 643, 645 has the shape of comparatively flat annular band. The protrusions are alternatively fixed, e.g. by welding, to the rotary base part 651 or the stationary base part 653. Since unimpeded relative rotation must be warranted, the protrusions 643, 645, and consequently also the heat transfer region 646, have an essentially rotationally symmetrical arrangement relative to the axis of rotation A. The respective diameter of each protrusion 643, 645 decreases towards axis A. It may be noted, that for alleviation purposes, the innermost protrusion of the rotary heat transfer element 642 is not shown in the partial view of FIGS. 13 and 14.

Figure 14:
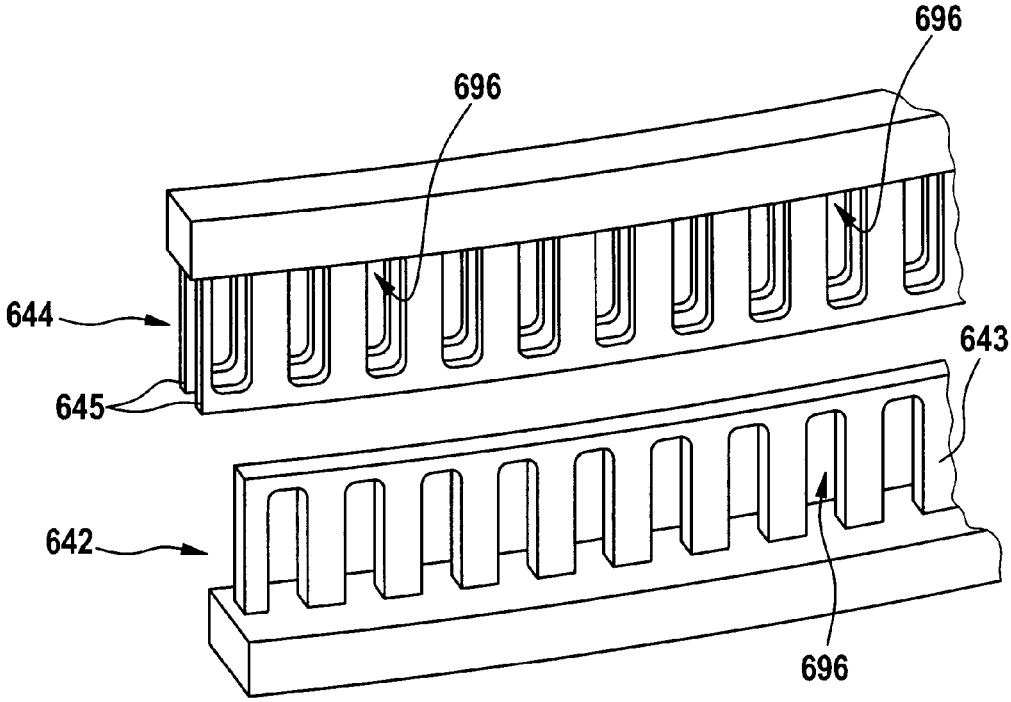
FIG. 14: is an exploded isometric view according to FIG. 13.

FIG. 14 partially shows the heat transfer elements 642 and 644 in disassembled condition. As is apparent from FIG. 14, each annular band-shaped protrusion 643, 645 is respectively provided with a plurality of circumferentially distributed transverse through holes 696. As will be appreciated, the through holes 696, during rotation of the rotary support 14, allow to create turbulence in the coupling fluid in the heat transfer region 646, e.g. in the thermally conductive liquid contained by the trough 690. It will also be appreciated that turbulence in the coupling fluid between the elements 642, 644 increases heat transfer that can be achieved by the heat transfer device 640. Although not shown in the drawings, the protrusions 643, 645 need not necessarily have a band type shape. In fact, to achieve turbulence, other types of protrusions may be used, provided that total heat transfer surface is sufficient, rotation is not impeded and a thermal connection to the respective rotary or stationary cooling circuit 30 or 32 is achieved. For example, band shaped protrusions with non penetrating depressions on either side, or annular rows of circumferentially distributed separate pins or bars forming protrusions by projecting from the respective base part of the rotary or stationary element, could be envisaged.

Figure 15:
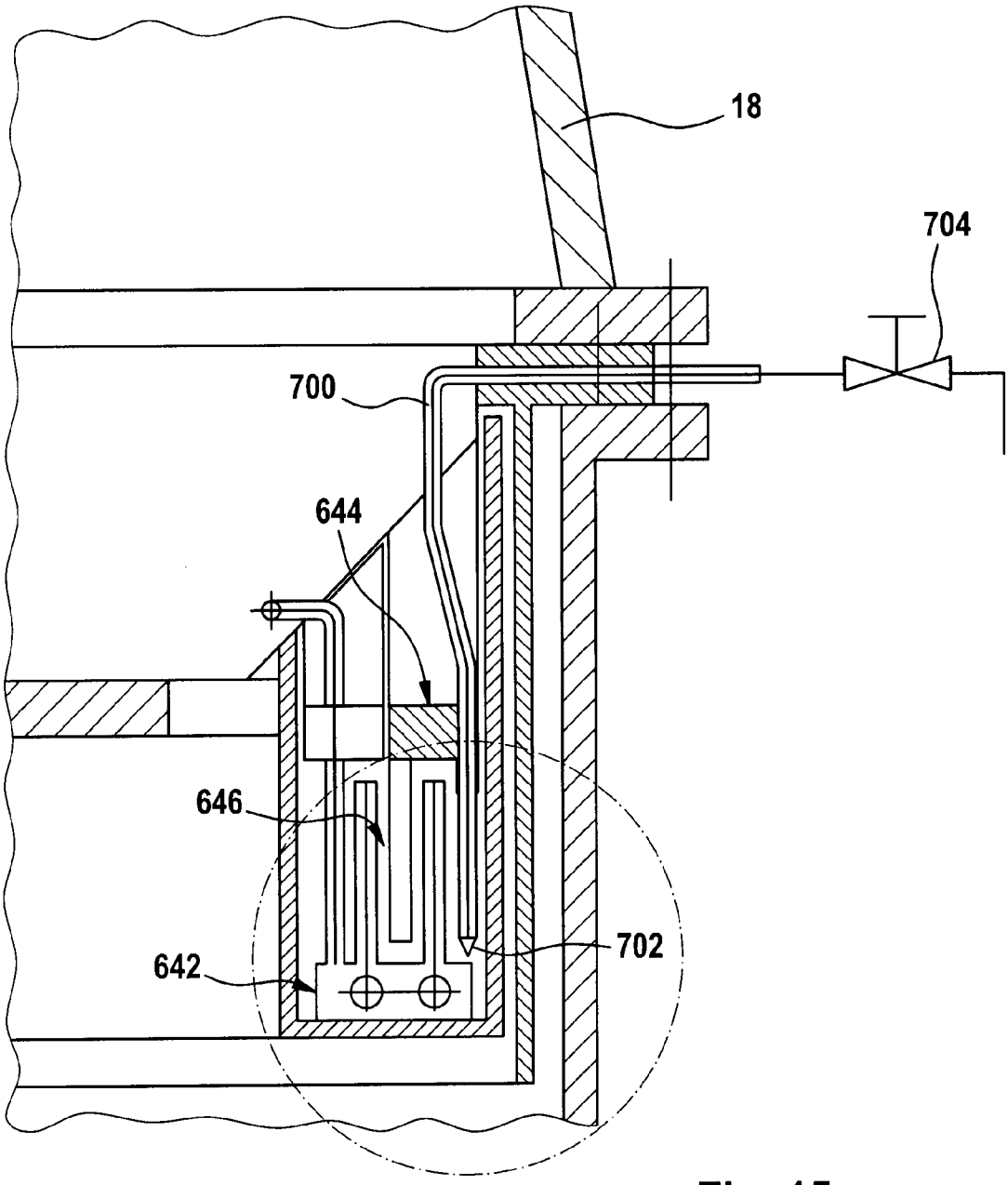
FIG. 15: is a different vertical cross-sectional view of the heat transfer device in the cooling system of FIG. 11, showing a supply nozzle.

FIG. 15 shows a vertical cross section of the heat transfer device 640 of FIG. 12 in a different section. As seen in FIG. 12, a supply conduit 700 mounted on the stationary housing 18 interrupts one of the protrusions of the stationary heat transfer element 644. The supply conduit 700 has a supply nozzle 702 at its lower end, arranged in the lower part of the trough 690, proximate to the rotary heat transfer element 642. The supply conduit 700 is connected to a source of thermally conductive liquid by means of a valve 704. As mentioned above, using a suitable level detection controlling the valve 704, the supply conduit 700 ensures automatic refilling of thermally conductive liquid in the heat transfer region 646. Thereby, loss of liquid due to evaporation is compensated and a sufficient liquid level is automatically warranted.

Figure 16:
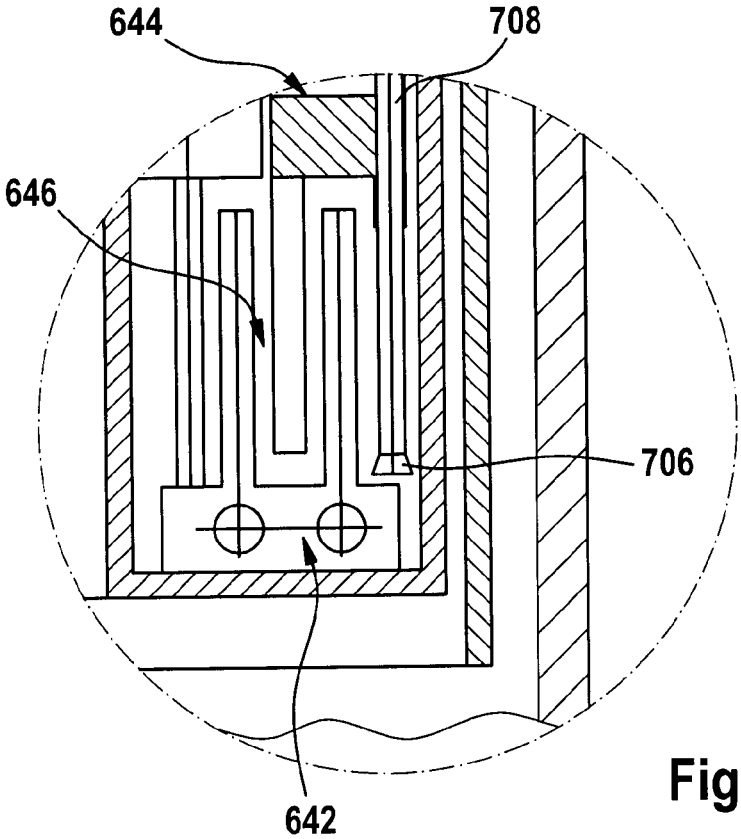
FIG. 16: is a partial view according to FIG. 15, showing a draining nozzle.

FIG. 16 shows a vertical cross section of the heat transfer device 640 of FIG. 12 in another different section. FIG. 16 shows a draining nozzle 706 connected to a draining conduit 708 installed according to FIG. 15. By virtue of the furnace throat pressure which pressurizes the liquid in the heat transfer region 646 above atmospheric pressure, the liquid can be easily purged by simply opening a corresponding (normally closed) valve on the draining conduit 708. Draining the liquid may be required when the latter has been excessively contaminated with dust particles or when cleaning of the heat transfer elements 642, 644 is required to remove excessive deposits.

Figure 17:
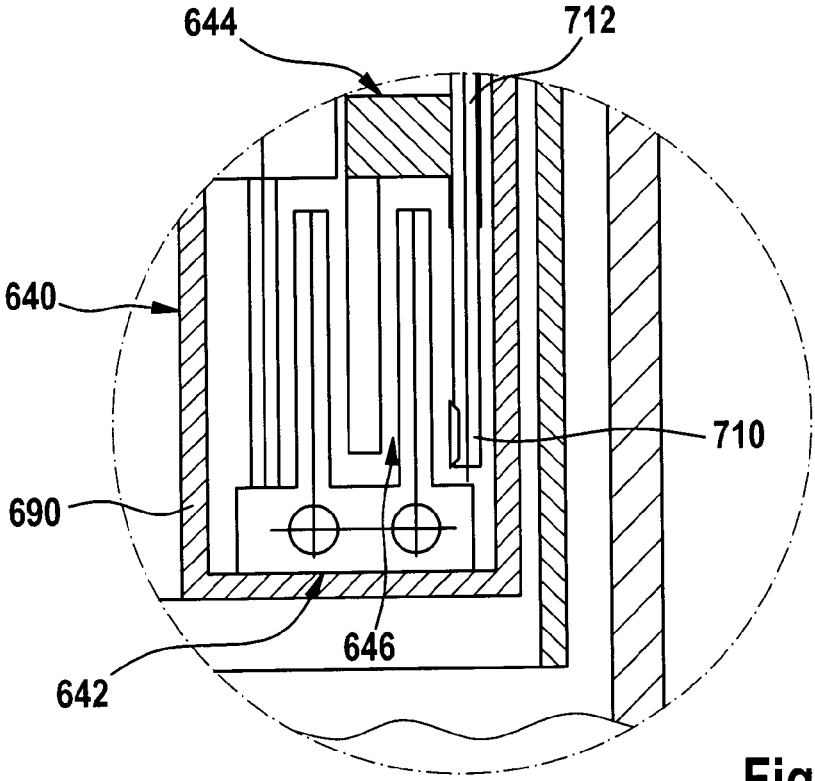
FIG. 17: is a partial view according to FIG. 15, showing a cleaning nozzle.

FIG. 17 shows a vertical cross section of the heat transfer device 640 of FIG. 12 in yet another different section. As seen in FIG. 17, a cleaning nozzle 710 is arranged on the end of a corresponding cleaning conduit 712 provided with a valve as shown in FIG. 15. The cleaning nozzle 710 is configured to provide high pressure flushing by means of a horizontally directed spray. Since the rotary heat transfer element 642 is arranged in the bottom part of the trough 690 it will be most exposed to dust deposits or other silting. The configuration according to FIG. 12 facilitates cleaning of the heat transfer device 640 because, when rotated, the entire rotary heat transfer element 642 can be easily cleaned by means of one or a few cleaning nozzles 710. Dismantling the heat transfer device 640 for cleaning purposes is hence normally not necessary. During cleaning, cleaning liquid collected in the heat transfer region 646, just like the thermally conductive liquid, can be discharged through the draining conduit 708 of FIG. 16 without further measures taking advantage of furnace throat pressure.

Although not explicitly shown in the drawings, it will be appreciated, that where required, any of the above cooling systems 12, 112, 212, 312, 412, 512 or 612 includes means for cooling the rotary chute 16. In fact, among the components of the charging device 10, the rotary chute 16 is most exposed to the inner atmosphere of the furnace. Therefore, a modified arrangement for chute cooling similar to that disclosed in U.S. Pat. No. 5,252,063 is included in the cooling system if required. In this embodiment, the rotary distribution chute 16 comprises a circuit portion (not shown) for cooling the lower surface of its body which is in fluidic connection with the rotary cooling circuit 30, 130, 230, 330, 430, 530 or 630. The connection is achieved, as known from U.S. Pat. No. 5,252,063, through channels passing through suspension shafts by which the chute 16 is pivotably attached to the rotatable support 14 and through suitable rotary connectors. As opposed to U.S. Pat. No. 5,252,063, according to the present invention, the circuit portion for chute cooling is however integral part of the closed cycle configuration of the rotary cooling circuit 30, 130, 230, 330, 430, 530 or 630.

In a further variant, in case the cooling fluid used in the rotary cooling circuit is a liquid, the latter may be used to supply the heat transfer region 146, 446 in the heat transfer device 140, 440 with a coupling liquid 156, 456. This can be achieved by means of a level detection and a suitable supply valve controlling liquid supply into the heat transfer region 146, 446. In this case a supply tank is preferably mounted on the stationary part of the charging device 10 to provide thermally conductive liquid in order compensate for evaporation losses of the coupling liquid 156, 456.

It remains to be noted that in any of the above variants and configurations, the rotary and stationary heat transfer elements 42, 44; 142, 144; 242, 244; 342, 344; 442, 444; 542, 544; or 642, 644; are made of a material having high thermal conductivity such as silver, copper or aluminium or a suitable alloy containing one or more of these metals. As will be understood, an anti-corrosion heat conductive coating is preferably applied to the heat transfer elements in order to increase their service life.

Finally, some advantages shared by the above cooling systems should be recapitulated. Due to the closed cycle arrangement of the rotary cooling circuit, the need for an independent circuit with a water treatment installation is eliminated. The stationary cooling circuit can be fully integrated with a closed loop cooling circuit usually already provided at the furnace. The cooling system is devoid of any notable wearing parts. Maintenance frequency and expenses are reduced. The pressure drop or flow resistance in the rotary cooling circuit is less critical since the fluid is not conveyed exclusively by gravitation. Less expensive and easier to install conduits, such as small diameter copper pipes suitable for manual bending, can therefore be used. The maximum operating temperature of the rotary cooling circuit can be increased with respect to the prior art. In fact, firstly a more expensive coolant can be used in the closed cycle, whereby any detrimental deposits in the rotary cooling circuit are avoided and secondly, due to the closed circuit configuration of the rotary circuit, the coolant therein can be pressurized so as to increase its vaporization point.

The invention claimed is:

1. A rotary charging device for a shaft furnace equipped with a cooling system, said rotary charging device comprising a rotatable support for rotary distribution means and a stationary housing for said rotatable support; and said cooling system comprising:

a rotary cooling circuit fixed in rotation with said rotatable support and a stationary cooling circuit on said stationary housing and a heat transfer device including:

a stationary heat transfer element configured to be cooled by a cooling fluid flowing through said stationary cooling circuit, and a rotary heat transfer element configured to be heated by a separate cooling fluid circulated in said rotary cooling circuit, said heat transfer elements being arranged in facing relationship and having there between a heat transfer region for achieving heat transfer by convection and/or radiation through said region without mixing of said separate cooling fluids.

2. The charging device according to claim 1, wherein said rotary cooling circuit is configured as closed circuit.

3. The charging device according to claim 2, wherein said rotary cooling circuit is configured as closed loop natural convection circuit.

4. The charging device according to claim 2, wherein said rotary cooling circuit comprises at least one heat pipe.

5. The charging device according to claim 2, wherein said rotary cooling circuit comprises at least one of a closed loop forced convection circuit, a closed loop vapour-compression refrigeration cycle and an adsorption cooling unit.

6. The charging device according to claim 5, wherein said rotary cooling circuit comprises at least one pump or compressor which is powered mechanically by means of a mechanism actuated by rotation of said rotatable support.

7. The charging device according to claim 5, wherein said rotary cooling circuit comprises at least one pump or compressor which is powered electrically either by means of a battery fed by a generator actuated by rotation of said rotatable support, by means of sliding contacts or by means of non-contacting inductive current transfer.

8. The charging device according to claim 1, wherein said stationary cooling circuit is part of a closed loop cooling circuit of said shaft furnace for carrying away heat transferred to said stationary heat transfer element.

9. The charging device according to claim 1, wherein at least one recess is provided in said rotary or stationary heat transfer element and at least one corresponding protrusion is provided in said stationary or rotary heat transfer element, said recess and said protrusion fitting together so as to give a meandering vertical cross-section to said heat transfer region.

10. The charging device according to claim 1, wherein said rotary heat transfer element and said stationary heat transfer element each comprise an annular base part and at least one protrusion protruding transversely from said base part, said protrusions being arranged in facing relationship and fitting together so as to give a meandering vertical cross-section to said heat transfer region.

11. The charging device according to claim 9, wherein said heat transfer region is at least partially filled with a thermally conductive liquid.

12. The charging device according to claim 10, wherein said heat transfer region is at least partially filled with a thermally conductive liquid.

13. The charging device according to claim 1, wherein the transverse width of said heat transfer region is in the range of 0.5-3mm.

14. The charging device according to claim 1, wherein said rotary cooling circuit comprises a circuit portion for cooling a rotary distribution chute supported by said rotatable support.

15. A rotary charging device for a shaft furnace, said rotary charging device comprising a rotatable support for rotary distribution means, a stationary housing for said rotatable support and a cooling system that comprises:

a rotary closed cooling circuit fixed in rotation on said rotatable support and a stationary cooling circuit that remains stationary with said housing and a heat transfer device including:

a stationary heat transfer element connected to said stationary cooling circuit for being cooled by a cooling fluid flowing through said stationary cooling circuit, and a rotary heat transfer element connected to said rotary cooling circuit for being heated by a separate cooling fluid circulated in said rotary cooling circuit, wherein said heat transfer elements are arranged in facing relationship for achieving heat transfer without mixing of the separate cooling fluids in said stationary cooling circuit and in said rotary cooling circuit.

16. The charging device according to claim 15, wherein said stationary heat transfer element and said rotary heat transfer element are arranged as circular rings.

17. The charging device according to claim 16, wherein said heat transfer elements comprise plane opposing heat transfer surfaces.

18. The charging device according to claim 17, wherein said heat transfer elements are separated by a gap which forms a heat transfer region through which said heat transfer is achieved by convection and/or radiation.

19. The charging device according to claim 18, wherein said gap is at least partially filled with a thermally conductive grease.

20. Blast furnace having a rotary charging device equipped with a cooling system, wherein said rotary charging device comprises a rotatable support for rotary distribution means and a stationary housing for said rotatable support; and said cooling system comprises:

a rotary cooling circuit fixed in rotation with said rotatable support, a stationary cooling circuit that is part of a closed loop cooling circuit of said blast furnace; and a heat transfer device including:

a stationary heat transfer element configured to be cooled by a cooling fluid flowing through said stationary cooling circuit, and a rotary heat transfer element configured to be heated by a separate cooling fluid circulated in said rotary cooling circuit, wherein said heat transfer elements are arranged in facing relationship and have there between a heat transfer region for achieving heat transfer through said region without mixing of said separate cooling fluids.

21. The charging device according to claim 11, wherein at least one protrusion of said rotary heat transfer element and/or of said stationary heat transfer element comprises means for turbulating said thermally conductive liquid.

22. The charging device according to claim 12, wherein at least one protrusion of said rotary heat transfer element and/or of said stationary heat transfer element comprises means for turbulating said thermally conductive liquid.

23. The charging device according to claim 16, wherein said circular gings extend essentially over the entire circumference about the axis of rotation of said rotatable support.

24. The charging device according to claim 18, wherein said heat transfer region has a transverse width in the range of 0.5-3mm.

* * * * *